US011849845B2

(12) United States Patent
Urban

(10) Patent No.: US 11,849,845 B2
(45) Date of Patent: Dec. 26, 2023

(54) CORNER RETENTION CLIP

(71) Applicant: Menasha Corporation, Neenah, WI (US)

(72) Inventor: Daniel J. Urban, Waukegan, IL (US)

(73) Assignee: Menasha Corporation, Neenah, WI (US)

( * ) Notice: Subject to any disclaimer, the term of this patent is extended or adjusted under 35 U.S.C. 154(b) by 1 day.

(21) Appl. No.: 17/592,048

(22) Filed: Feb. 3, 2022

(65) Prior Publication Data

US 2022/0248847 A1 Aug. 11, 2022

Related U.S. Application Data

(60) Provisional application No. 63/148,406, filed on Feb. 11, 2021.

(51) Int. Cl.

| | |
|---|---|
| ***A47B 96/02*** | (2006.01) |
| ***A47F 5/00*** | (2006.01) |
| *A47B 96/06* | (2006.01) |

(52) U.S. Cl.

CPC ..... *A47B 96/024* (2013.01); *A47F 5/0043* (2013.01); *A47B 96/063* (2013.01); *A47B 96/066* (2013.01)

(58) Field of Classification Search

CPC ..... A47B 96/063; A47B 96/066; A47B 96/00; A47B 96/02; A47B 96/024; A47B 96/06; A47G 1/1653; A47F 5/00; A47F 5/0043

USPC .... 248/235, 239, 241, 247, 250, 220.1, 243, 248/244, 248, 300

See application file for complete search history.

(56) References Cited

U.S. PATENT DOCUMENTS

| | | | | |
|---|---|---|---|---|
| 197,667 | A | 11/1877 | Roberts | |
| 497,594 | A | 5/1893 | McGrady | |
| 925,757 | A | 6/1909 | Cuny et al. | |
| 1,475,315 | A | 11/1923 | Quin | |
| 1,520,520 | A | 12/1924 | Thomason | |
| 1,551,880 | A | 9/1925 | Holman | |
| 1,763,024 | A | 6/1930 | Underhill et al. | |
| 2,103,106 | A | 12/1937 | Yurkovitch | |
| 2,700,475 | A * | 1/1955 | Stalter | A47B 96/022 248/248 |
| 3,011,235 | A | 12/1961 | Pacheco | |
| 3,039,340 | A | 6/1962 | Livermont | |
| 3,561,715 | A * | 2/1971 | Klein | A47B 57/425 248/248 |
| 3,760,465 | A * | 9/1973 | Brennan | B65D 5/448 229/198.1 |
| 4,230,052 | A * | 10/1980 | Champagne | F16B 12/02 108/147.14 |
| RE30,850 | E | 1/1982 | Gordy et al. | |
| 4,324,503 | A | 4/1982 | Sevrence | |
| 4,389,133 | A | 6/1983 | Oberst | |

(Continued)

*Primary Examiner* — Christopher Garft
*Assistant Examiner* — Michael McDuffie
(74) *Attorney, Agent, or Firm* — GREENSFELDER, HEMKER & GALE, P.C.; Richard C. Himelhoch

(57) ABSTRACT

The invention is directed to a corner retention clip system for supporting the front two corners of a shelf in a shelving system. Each corner retention clip includes a generally horizontal support panel, a channel connected to the support panel for receiving a front lip of a shelf of the shelving display and a side wall connector for connecting the clip to a side wall of the shelving display.

20 Claims, 8 Drawing Sheets

(56) References Cited

U.S. PATENT DOCUMENTS 4,565,465 A 1/1986 Oberst
4,787,595 A 11/1988 Hegarty
4,828,133 A 5/1989 Hougendobler
4,925,146 A 5/1990 Hegarty
4,929,116 A 5/1990 Mahl
4,976,567 A 12/1990 Spier
5,044,594 A 9/1991 Hegarty
5,080,238 A 1/1992 Hochman
5,170,977 A * 12/1992 McMillan ..... E04B 1/2608 52/712
5,312,078 A * 5/1994 Marsh ..... A47B 96/06 403/231
5,425,520 A * 6/1995 Masumoto ..... F16B 12/44 403/231
5,431,336 A * 7/1995 Clee ..... B65D 11/1833 229/199
5,531,326 A * 7/1996 Hummel ..... B65D 5/006 220/640
5,678,797 A * 10/1997 Gogan ..... A47B 88/969 211/183
5,707,033 A 1/1998 Holt et al.
5,715,956 A * 2/1998 Yoshida ..... A47B 96/06 211/186
6,641,420 B2 11/2003 Blanchfield et al.
D549,564 S 8/2007 Lucht
D550,070 S 9/2007 Lucht
8,011,160 B2 * 9/2011 Rice ..... E04B 2/763 52/712
8,186,726 B2 5/2012 Zuo
8,251,222 B2 * 8/2012 Rego Garcia De Alba ..... B65D 19/385 220/4.28
8,454,262 B2 6/2013 Norman
8,562,084 B2 * 10/2013 Chen ..... H04Q 1/025 312/223.1
8,690,471 B2 * 4/2014 Wians ..... A47B 47/00 211/183
8,720,839 B2 * 5/2014 Lijesnic ..... A47B 47/0033 403/231
9,157,619 B1 * 10/2015 Newton ..... F21V 21/02
9,669,976 B2 6/2017 Kastanek et al.
10,167,108 B2 1/2019 Nugent et al.
10,181,273 B2 1/2019 Norman et al.
10,323,668 B2 * 6/2019 Hiller ..... F16B 15/0053
10,799,025 B2 * 10/2020 Malott ..... A47B 96/06
11,420,664 B2 * 8/2022 Liao ..... A47B 31/00
2005/0133676 A1 6/2005 Brinkman et al.
2010/0129146 A1 5/2010 Norman
2010/0205841 A1 8/2010 Stancer, III
2011/0290967 A1 * 12/2011 Ringenbach ..... E03F 5/0404 248/224.8
2016/0227924 A1 * 8/2016 Chen ..... A47B 47/0033
2016/0372012 A1 12/2016 Norman et al.
2017/0204622 A1 * 7/2017 Jaskiewicz ..... E04F 21/0023
2018/0127144 A1 5/2018 Nugent et al.
2021/0022501 A1 * 1/2021 Cluff ..... A47B 96/063

* cited by examiner

CORNER RETENTION CLIP

CROSS-REFERENCE TO RELATED APPLICATIONS

The present invention claims priority to and the benefit of U.S. Provisional Patent Application No. 63/148,406 filed Feb. 11, 2021, the contents of which are incorporated herein by reference and made a part hereof.

FEDERALLY SPONSORED RESEARCH OR DEVELOPMENT

N/A

FIELD OF THE INVENTION

The present invention relates to a corner retention clip system for supporting the front corner portions of a shelf on a shelving display and more particularly to a pair of plastic corner retention clips that can be connected to the side walls of a shelving display to support the lip of the front corner portions of a shelf on the shelving display.

DESCRIPTION OF THE PRIOR ART

Prior systems to support a shelf of a shelving system included separate pieces that had to be attached to the side walls of the shelving display and to the shelves. The separate pieces would need to be engaged when assembling the display.

The present invention provides a quick and easy way to support shelves in a shelving display using a single piece that only requires being attached to the side wall.

SUMMARY OF THE INVENTION

The present invention is directed to a corner retention clip system for supporting the front corner portions of a shelf in a shelving display. The system includes two corner retention clips connected to each other by frangible ribs—one clip for the left side of the shelf and one clip for the right side of the shelf.

In accordance with one aspect of the invention, a corner retention clip for use in a shelving display comprises a generally horizontal support panel, a channel connected to the support panel for receiving a front lip of a shelf of the shelving display and a side wall connector for connecting the clip to a side wall of the shelving display. The clip can be part of a system having two clips connected to each other or provided separately.

The channel can include a lip support panel and a front panel spaced from the horizontal support panel by the lip support panel. The front panel can have an arcuate edge or some other ornamental design or configuration.

The corner retention clip can further comprise a side panel connected to the horizontal support panel and the channel. The side wall connector can extend from the side panel of the clip. The side wall connector can include a tab which can be inserted into a slot in the side wall of the shelving display. The tab can be connected to the side wall by a rib.

The corner retention clip can further comprise a first positioning pin extending upward from the horizontal support surface. The first positioning pin is configured to engage an opening in a top surface of a shelf of the shelving display to assist in keeping the shelf in place. The first positioning pin on the support panel can have a rectangular shape that fits a rectangular opening on the shelf. Other shapes could also be used.

The corner retention clip can also comprise a lower vertical panel extending downward from a front edge of the support panel. The vertical panel includes a second positioning pin extending outward from the vertical panel. The second positioning pin is configured to engage an opening in a lip portion of a shelf of the shelving display. The second positioning pin has a round shape to match a round opening in the lip of the shelf. Again, other shapes could be used.

The corner retention clip can be formed from an injection molded plastic. The clip can be made on its own, or be a portion of a two clip system that is connected to a second clip portion by frangible ribs.

In accordance with another aspect of the present invention, a corner retention clip system for use with a shelving display is provided. The system comprises a first clip portion having a first panel for supporting a first side of a horizontal support surface of a shelf, and a first channel connected to the first panel for supporting a lip portion of the shelf, and a second clip portion connected to the first clip portion, the second clip portion having a second panel for supporting a second side of the horizontal support surface of a shelf, and a second channel connected to the second panel for supporting the lip portion of the shelf. The first clip portion can be connected to the second clip portion by frangible ribs.

The first clip portion can include a side wall connector for connecting the first clip portion to a left side wall of the shelving display. Similarly, the second clip portion includes a side wall connector for connecting the first clip portion to a right side wall of the shelving display.

Additionally, the first panel of the first clip portion can include a first pin extending upward from the first panel. The first pin is for engaging an opening on the shelf to help keep the shelf in place on the first clip portion. Again, the second panel of the second clip portion can include a second pin extending upward from the first panel.

The first clip portion can include an indicator which designates the first clip portion for connection to the left side wall of the shelving display and the second clip portion can include an indicator which designates the second clip portion for connection to the right side wall of the shelving display.

The first clip portion and the second clip portion can be a single, injection molded plastic piece.

Other features and advantages of the invention will be apparent from the following specification taken in conjunction with the following Figures.

BRIEF DESCRIPTION OF THE DRAWINGS

To understand the present invention, it will now be described by way of example, with reference to the accompanying drawings in which.

DETAILED DESCRIPTION

Figure 1:
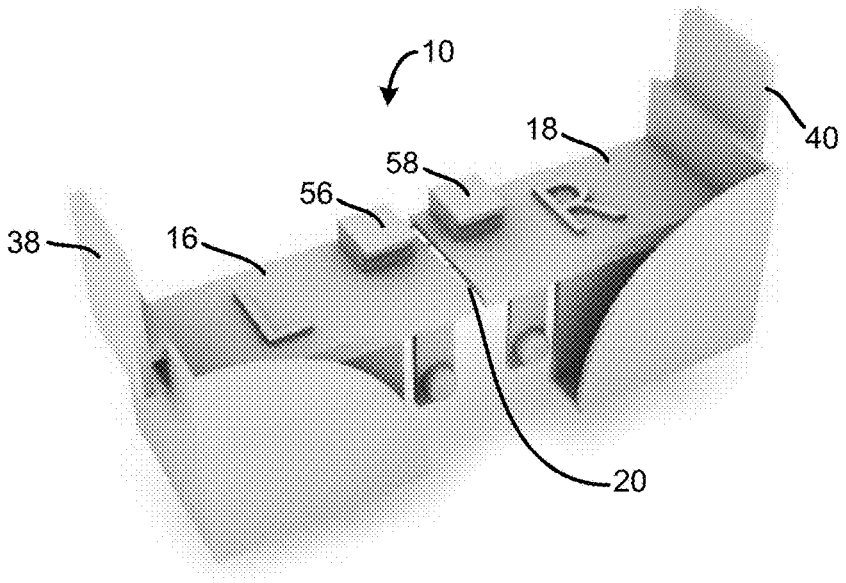
FIG. 1 is a perspective view of a corner retention clip system in accordance with an embodiment of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
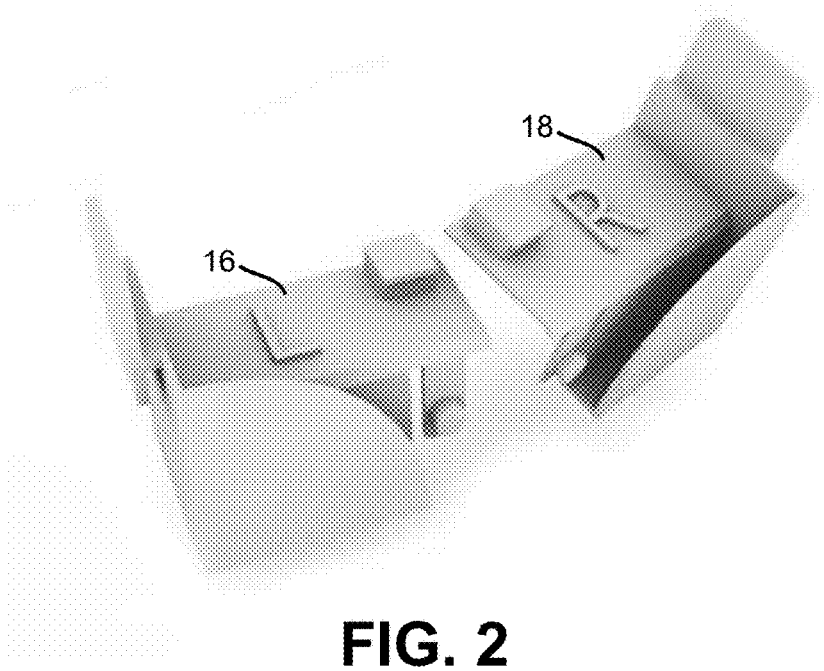
FIG. 2 is a perspective view of the corner retention clip system of FIG. 1 split into a left side corner retention clip and a right side corner retention clip.
Figure 3:
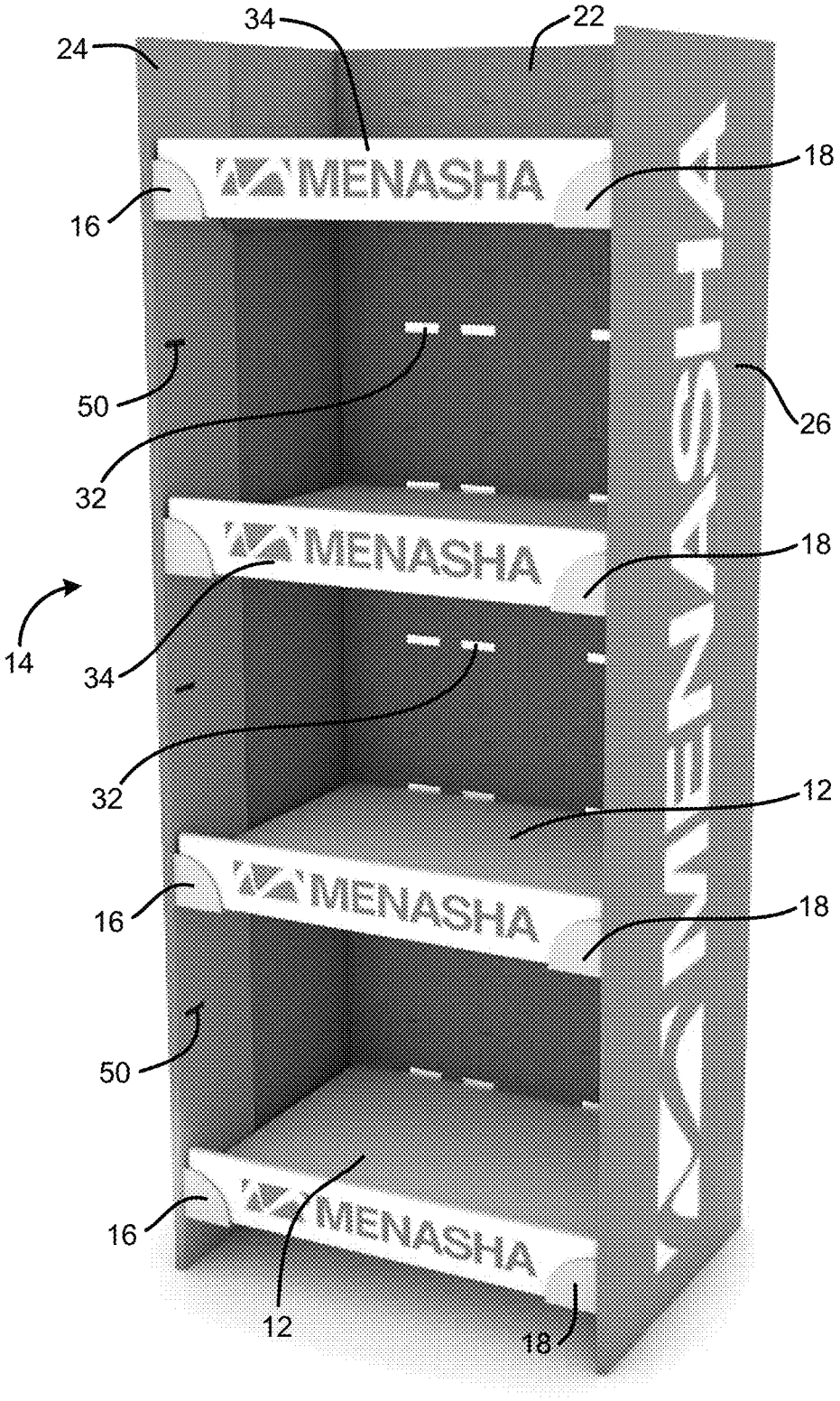
FIG. 3 is a perspective view of a shelving display utilizing a corner retention clip system with each shelf.

FIGS. 1 and 2 show a corner retention clip system 10 for supporting the two front corner portions of a shelf 12 of shelving display 14 as shown in FIG. 3. As shown in FIG. 3, the shelving display 14 is formed from a corrugated paper or plastic material that is cut from a blank and then folded and assembled.

The corner retention clip system 10 is preferably an injection molded plastic piece. As evident in FIGS. 1 and 2, each injection molded piece includes a first retention clip portion 16 which can be used for the left side of the shelf 12 (for someone facing the shelving system 14) and a second retention clip portion 18 which can be used for the right side of the shelf 12 (again, for someone facing the shelving system 14).

The first retention clip portion 16 and the second retention clip portion 18 are connected to each other by frangible ribs 20. The two retention clip portions 16, 18 can be snapped apart by breaking the ribs 20. In this manner a single retention clip system 10 can be used for both front corners of a shelf 12. This allows for a single mold to form both portions 16, 18. While both the first and second retention clip portions 16, 18 are preferably formed in a single mold, two molds can be used to separately form the first retention clip portion 16 and the second retention clip portion 18 (without the ribs).

Referring to FIG. 3, the shelving display 14 includes a back wall 22, a first side wall 24 and a second side wall 26. A plurality of shelves 12 extend from the back wall 22 and between the first and second side walls 24, 26.

Figure 5:
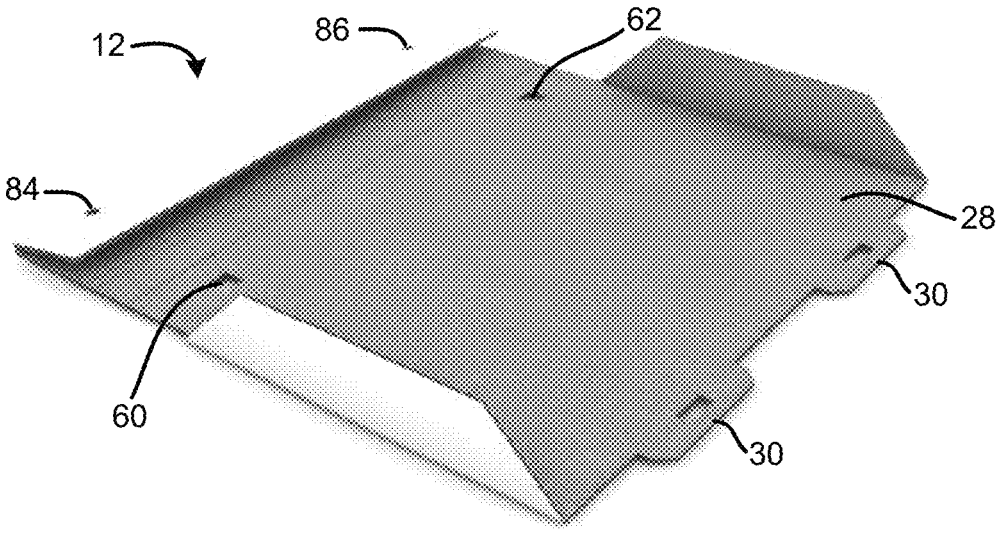
FIG. 5 is a perspective view of an unfolded shelf for use in the shelving display.
Figure 6:
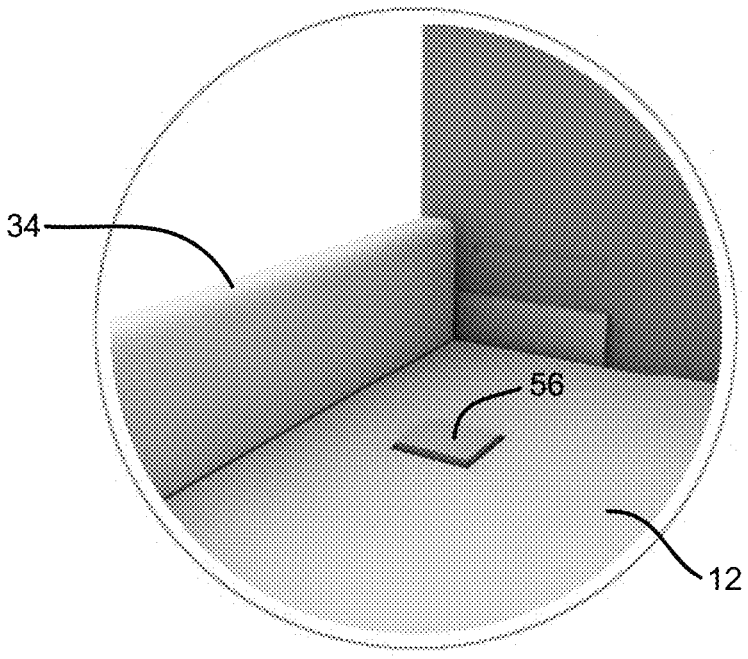
FIG. 6 is a perspective view of a positioning pin of a corner retention clip in an upper support surface of a shelf of a shelving display.

As shown in the partially folded shelf blank in FIG. 5, each shelf 12 includes a rectangular support surface 28 and tabs 30 extending outward from one edge of the support surface 28. The tabs 28 cooperate with slots 32 in the back wall 22 of the shelving display 14 to secure the back portion of each shelf 12 to the display 14. A plurality of retention clip systems 10, one system 10 (i.e., a set of clips 16, 18) for each shelf 12 in the display 14, are used to support the front portion of each shelf 12.

The front portion of each shelf 12 includes a front panel 34 (formed from folded panels of the shelf blank) that extends both above and below the support surface 28. The upper portion of the front panel 34, that extends above the support surface 28, acts as a wall to prevent items on the shelf 12 from falling off. The lower portion 36 that extends below the support surface 28 acts like a lip that cooperates with the retention clip portions 16, 18 to support the front of the shelf 12.

Referring to FIGS. 1, 2 and 9-11, each portion 16, 18 of the corner retention clip system 10 includes a display side wall connector 38, 40 that extends outward from a side wall 42, 44 of the clip portion 16, 18. Each connector 38, 40 is connected to the side wall 42, 44 of the clip portion 16, 18 by a rib 46, 48. As described herein, the side wall connectors 38, 40 cooperate with slots 50 in the shelving display 14 to connect the corner retention clip portions 16, 18 to the shelving display 14.

Each corner retention clip portion 16, 18 also includes a horizontal support surface 52, 54 connected to the side wall 42, 44 of the respective retention clip portion 16, 18. The horizontal support surface 52, 54 is designed to contact a front corner portion of the support surface 28 of a shelf 12. Each horizontal support surface 52, 54 includes a pin 56, 58 that extends upward from the surface. The pin 56, 58 has a generally rectangular shape. The shape is configured to fit a similarly shaped opening 60, 62 in the support surface 28 of the shelf 12. This helps hold the shelf 12 in place on the horizontal support surface 52, 54 of the retention clip portion 16, 18.

The retention clip portions 16, 18 also include a channel 64, 66 for supporting the lip formed by the lower portion 36 of the front wall 34 of the shelf 12. The channel 64, 66 includes a front wall 68, 70 connected to the side wall 42, 44, a back wall 72, 74 extending downward from the horizontal support surface 52, 54 and a bottom lip support panel 76, 78 between the front wall 68, 70 and the back wall 72, 74. The front wall 68, 70 of the channel 64, 66 has an arcuate edge portion extending from the top proximate the side wall 42, 44 to the bottom proximate the lip support panel 76, 78.

Each retention clip portion 16, 18 also includes a positioning pin 80, 82 for engaging an opening 84, 86 in the lip of the front wall 34 of the shelf 12. The positioning pin 80, 82 extends outward from a tab 88, 90 extending downwardly from the horizontal support surface 52, 54. The tab 88, 90 is spaced from the inner wall 72, 74 of the channel 64, 66. The positioning pin 80, 82 helps hold the shelf 12 in place on the clip portion 16, 18 as shown in FIG. 7.

Figure 4A:
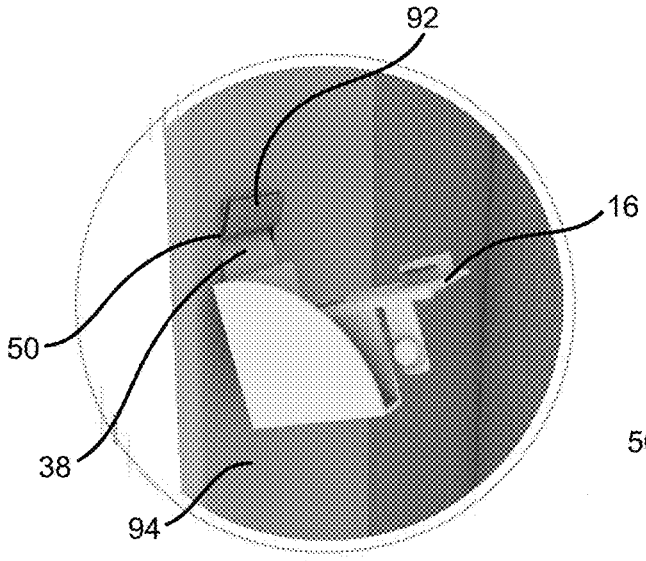
FIGS. 4A-4D illustrate installing a corner retention clip on a shelving display.
Figure 4B:
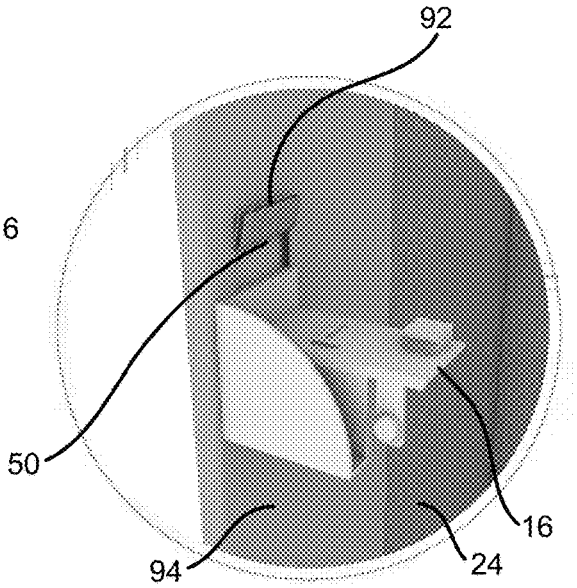
Figure 4C:
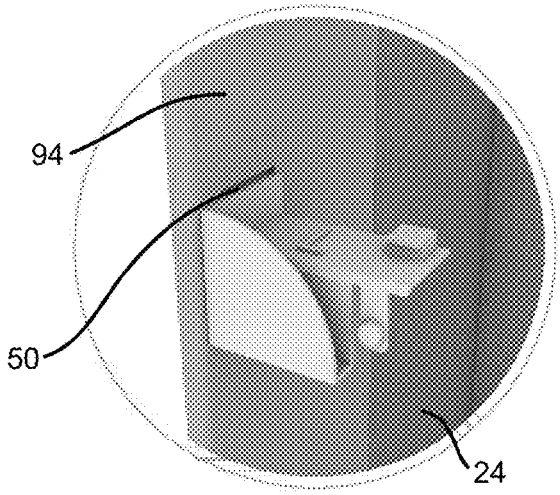
Figure 4D:
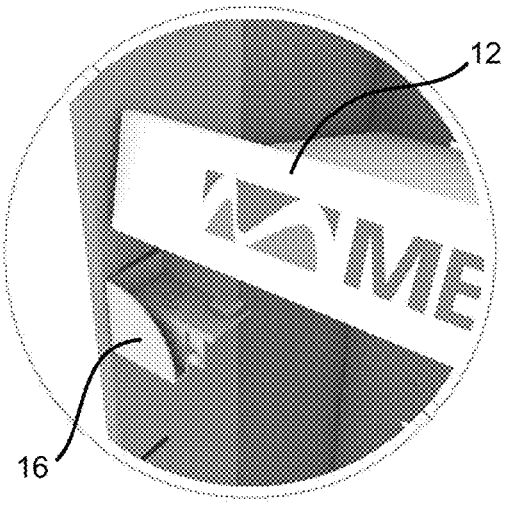
Figure 8:
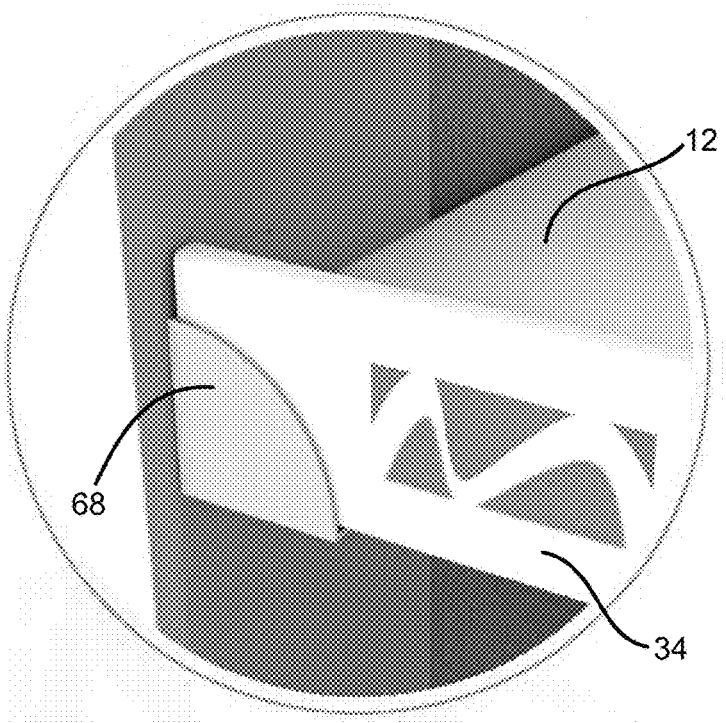
FIG. 8 is a close up perspective view of a corner retention clip on a shelf of a shelving display.
Figure 9:
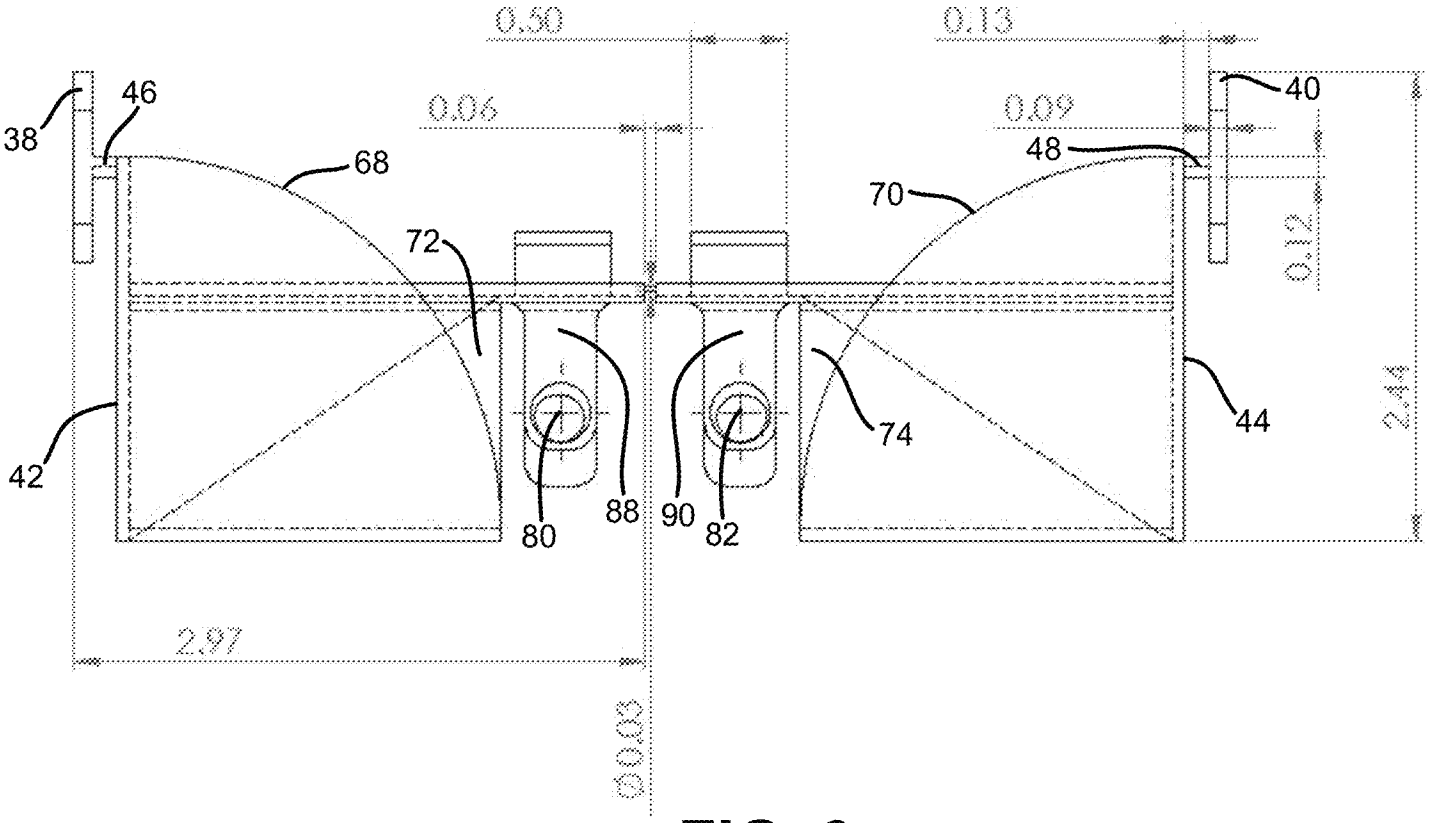
FIG. 9 is a side plan view of the corner retention clip system of the present invention.
Figure 10:
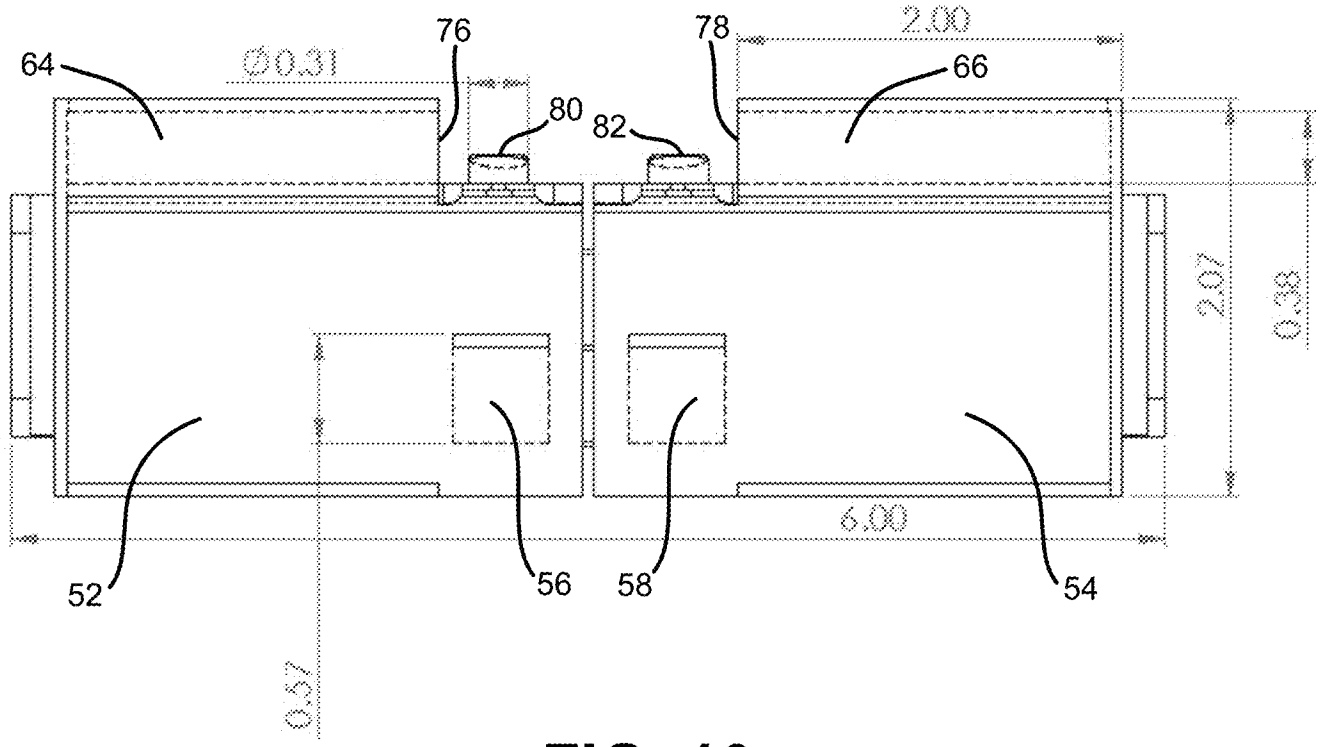
FIG. 10 is a top plan view of the corner retention clip system.
Figure 11:
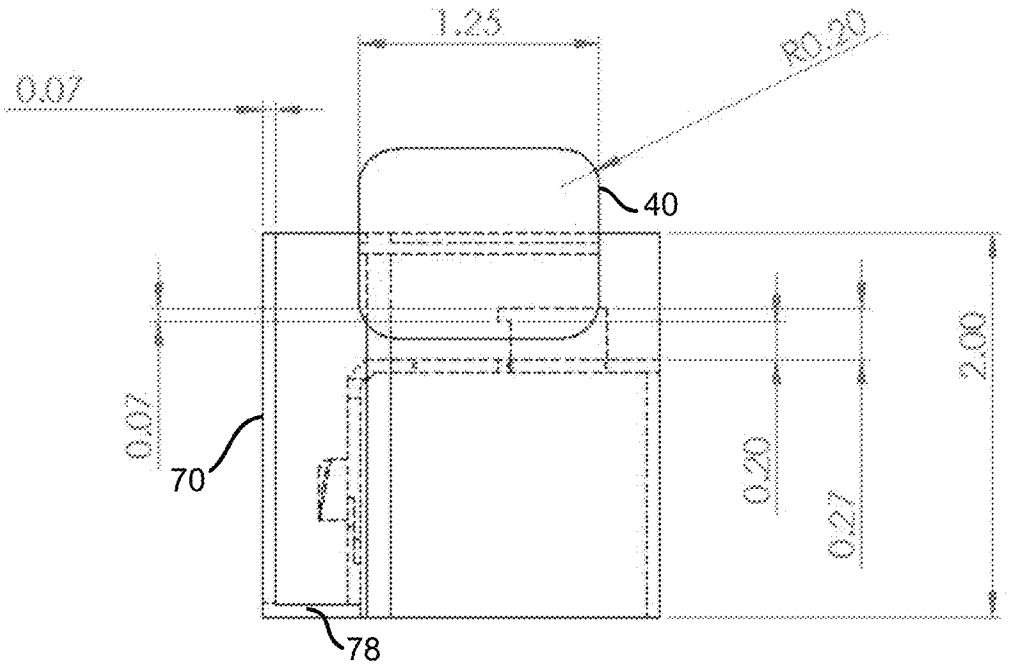
FIG. 11 is an end plan view of the corner retention clip system.

FIGS. 4A-4D illustrate installation of a corner retention clip portion 16 into the side wall 24 of the shelving display 14. As shown in FIGS. 4A and 4B, a tab 92 above the slot 50 in the side wall 24 is pulled upward to enable the side wall connector 38 of the clip portion 16 to be inserted. The tab 92 is then lowered, as evident in FIG. 4C, and the shelf 12 is positioned in place as shown in FIG. 4D. In this instance, the side wall 24 of the shelving display 14 includes an end panel 94 folded back over the side wall 24. This ensures the side wall connector 38 is not exposed on the other side of the side wall 24. The final view of the shelf 12 in place in the corner retention clip 16 is shown in FIG. 8.

Figure 7:
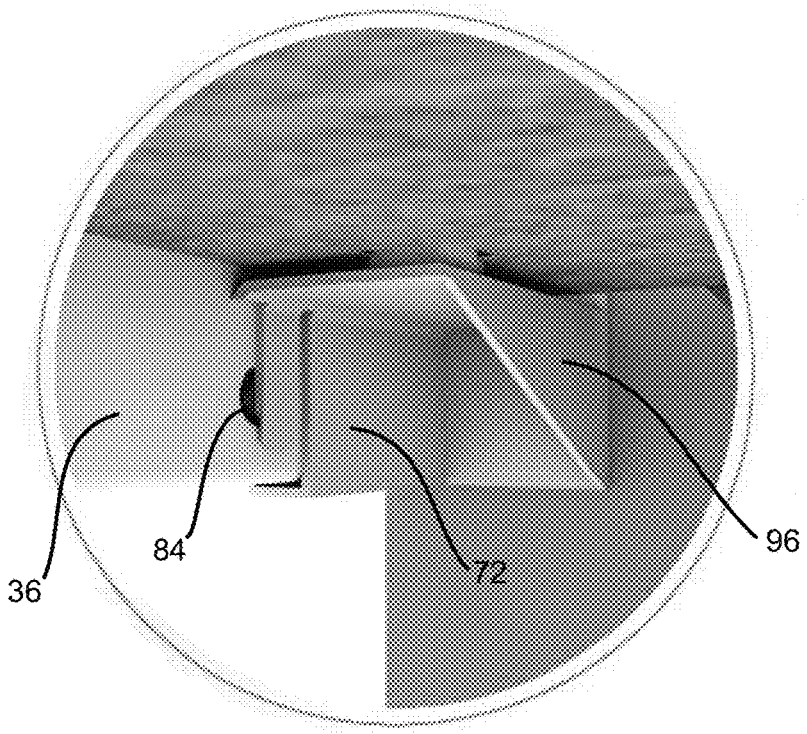
FIG. 7 is a lower perspective view of a corner retention clip and a positioning pin for a lip of a shelf of a shelving display.

As shown in FIG. 7, the corner retention clip portion 16 also includes other features, such as a back brace 96 that extends downward from a back edge of the horizontal support surface 52. As evident in FIGS. 1 and 2, each clip portion 16, 18 can include indicia indicating which side of the shelf 12 the portion should be installed.

Many modifications and variations of the present invention are possible in light of the above teachings. It is, therefore, to be understood within the scope of the appended claims the invention may be protected otherwise than as specifically described.

I claim:

1. A corner retention clip for use in supporting a front corner of a shelf of a shelving display comprising:

a generally horizontal support panel positioned to contact a bottom surface of the shelf of the shelving display proximate the front corner of the shelf;

a channel connected to the support panel for receiving a front lip of the shelf of the shelving display; and, a side wall connector extending outward from the horizontal support for connecting the clip to a side wall of the shelving display.

2. The corner retention clip of claim 1 wherein the channel includes a lip support panel and a front panel spaced from the horizontal support panel by the lip support panel.

3. The corner retention clip of claim 2 wherein the front panel has an arcuate edge.

4. The corner retention clip of claim 2 further comprising a side wall connected to the horizontal support panel and the channel.

5. The corner retention clip of claim 4 wherein the side wall connector extends from the side wall of the clip.

6. The corner retention clip of claim 5 wherein the side wall connector can be inserted into a slot in the side wall of the shelving display.

7. The corner retention clip of claim 1 further comprising a first positioning pin extending upward from the horizontal support surface wherein the first positioning pin is configured to engage an opening in a top surface of a shelf of the shelving display to assist in keeping the shelf in place.

8. The corner retention clip of claim 7 wherein the first positioning pin on the support panel has a rectangular shape.

9. The corner retention clip of claim 7 further comprising a tab extending downward from a front edge of the support panel, the vertical panel including a second positioning pin extending outward from the vertical panel wherein the second positioning pin is configured to engage an opening in a lip portion of a shelf of the shelving display.

10. The corner retention clip of claim 9 wherein the second positioning pin has a round shape.

11. The corner retention clip of claim 1 wherein the clip is formed from an injection molded plastic.

12. The corner retention clip of claim 1 wherein the clip is part of a two clip system and is connected to another clip by frangible ribs.

13. A corner retention clip system for supporting a front portion of a shelf of a shelving display comprising:

a first clip portion having a first panel for supporting a first front corner of a horizontal support surface of a shelf, and a first channel extending below the first panel and connected to a front edge of the first panel for supporting a lip portion of the shelf proximate the first corner of the shelf; and, a second clip portion connected to the first clip portion, the second clip portion having a second panel for supporting a second front corner of the horizontal support surface of a shelf, and a second channel extending below the first panel and connected to a front edge of the second panel for supporting the lip portion of the shelf proximate the second corner of the shelf.

14. The corner retention clip system of claim 13 wherein the first clip portion is connected to the second clip portion by frangible ribs.

15. The corner retention clip system of claim 13 wherein the first clip portion includes a side wall connector for connecting the first clip portion to a left side wall of the shelving display.

16. The corner retention clip system of claim 15 wherein the second clip portion includes a side wall connector for connecting the first clip portion to a right side wall of the shelving display.

17. The corner retention clip system of claim 13 wherein the first panel of the first clip portion includes a first pin extending upward from the first panel, the first pin for engaging an opening on the shelf to help keep the shelf in place on the first clip portion.

18. The corner retention clip system of claim 17 wherein the second panel of the second clip portion includes a second pin extending upward from the first panel, the second pin for engaging an opening on the shelf to help keep the shelf in place on the second clip portion.

19. The corner retention clip system of claim 16 wherein the first clip portion has an indicator which designates the first clip portion for connection to the left side wall of the shelving display and the second clip portion has an indicator which designates the second clip portion for connection to the right side wall of the shelving display.

20. The corner retention clip system of claim 13 wherein the first clip portion and the second clip portion are an injection molded plastic.

* * * * *